US005498153A

United States Patent [19]

Jones

[11] Patent Number: 5,498,153

[45] Date of Patent: Mar. 12, 1996

[54] GAS FLARE

[76] Inventor: Wendyle Jones, R.R. #2, Rocky Mountain House, Alberta, Canada, T0M 1T0

[21] Appl. No.: 279,397

[22] Filed: Jul. 25, 1994

[51] Int. Cl.[6] ..... F23D 14/00

[52] U.S. Cl. ..... 431/202; 431/5; 431/117; 431/119; 431/243

[58] Field of Search ..... 431/5, 11, 202, 431/181, 187, 243, 244, 65, 117, 118, 119

[56] References Cited

U.S. PATENT DOCUMENTS

| | | | |
|---|---|---|---|
| 2,131,977 | 10/1938 | Schwalbe | 431/181 X |
| 2,636,554 | 4/1953 | Young | 431/187 X |
| 3,658,482 | 4/1972 | Evans et al. | 23/277 C |
| 4,255,120 | 3/1981 | Straitz, III | 431/202 |
| 4,269,583 | 5/1981 | Straitz, III | 431/202 |
| 4,389,185 | 6/1983 | Alpkvist | 431/243 X |
| 4,480,986 | 11/1984 | Nelson et al. | 431/243 X |
| 4,516,932 | 5/1985 | Chaudet | 431/202 |
| 4,799,878 | 1/1989 | Schaeffer | 431/202 |
| 4,802,423 | 2/1989 | Pennington | 110/233 |
| 4,892,477 | 1/1990 | Zimmionid | 431/202 |
| 4,975,042 | 12/1990 | Schwartz et al. | 431/5 |
| 5,253,596 | 10/1993 | Bono Coraggioso | 110/21 |
| 5,380,195 | 1/1995 | Reid et al. | 431/202 |

FOREIGN PATENT DOCUMENTS

| | | | |
|---|---|---|---|
| 2029168 | 12/1971 | Germany | 431/5 |

*Primary Examiner*—Carl D. Price
*Attorney, Agent, or Firm*—Anthony R. Lambert

[57] ABSTRACT

A gas flare is described which includes a vent stack for combustion air having a first end and a second end. A gaseous fuel cyclone chamber surrounds the vent stack. The cyclone chamber has an interior wall conterminous with the vent stack and an exterior wall spaced from the vent stack. The cyclone chamber has a narrowing defining an access opening adjacent the first end of the vent stack. A gaseous fuel injection ring surrounds the first end of the vent stack with fuel nozzles extending into the access opening of the cyclone chamber. Gaseous fuel is fed into the cyclone chamber for thorough mixing prior to combustion. An igniter is positioned above the first end of the vent stack. Gaseous fuel flowing under pressure from the cyclone chamber creates a venturi effect drawing air up the vent stack to form a mixture of air and gaseous fuel which is ignited by the igniter. A combustion air passage communicates with the second end of the vent stack. The combustion air passage follows a circuitous route passing along the exterior wall of the cyclone chamber adjacent the first end of the vent stack such that cool combustion air passing through the combustion air passage draws heat from cyclone chamber to reduce heat build up adjacent the first end of the vent stack.

10 Claims, 2 Drawing Sheets

GAS FLARE

BACKGROUND OF THE INVENTION

There are a number of factors that can adversely affect the efficiency of a gas flare. One factor is the need to mix sufficient oxygen with the gaseous fuel. Another factor is the need to control heat build up. It is difficult to effectively address these factors without making the resulting gas flare unduly complex.

SUMMARY OF THE INVENTION

What is required is an efficient gas flare of simple design.

According to the present invention there is provided a gas flare which includes a vent stack for combustion air having a first end and a second end. A gaseous fuel cyclone chamber surrounds the vent stack. The cyclone chamber has an interior wall conterminous with the vent stack and an exterior wall spaced from the vent stack. The cyclone chamber has a narrowing defining an access opening adjacent the first end of the vent stack. A gaseous fuel injection ring surrounds the first end of the vent stack with fuel nozzles extending into the access opening of the cyclone chamber. Gaseous fuel is fed into the cyclone chamber for thorough mixing prior to combustion. An igniter is positioned above the first end of the vent stack. Gaseous fuel flowing under pressure out of the cyclone chamber creates a venturi effect drawing air from the vent stack to form a mixture of air and gaseous fuel which is ignited by the igniter. A combustion air passage communicates with the second end of the vent stack. The combustion air passage follows a circuitous route passing along the exterior wall of the cyclone chamber adjacent the first end of the vent stack such that cool combustion air passing through the combustion air passage draws heat from cyclone chamber to reduce heat buildup adjacent the first end of the vent stack.

It is preferred that the exterior wall of the cyclone chamber is generally conical in shape. It is preferred that the combustion air passage have a first portion extending radially outward from the second end of the vent stack, a second portion extending from the first portion along the exterior wall of the cyclone chamber toward the first end of the vent stack and a third portion extending away from the first end of the vent stack parallel to the second portion and terminating in an inlet.

Although beneficial results may be obtained through the use of the gas flare, as described above, in some installations the gaseous fuel is mixed with liquid hydrocarbons. Even more beneficial results may, therefore, be obtained when a liquid containment chamber is disposed beneath the second end of the vent stack. It is preferred that the first portion of the combustion air passage underlies the cyclone chamber and has drainage passages communicating with the underlying liquid containment chamber whereby liquids released from the gaseous fuel in the cyclone chamber are drained to the underlying containment chamber.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
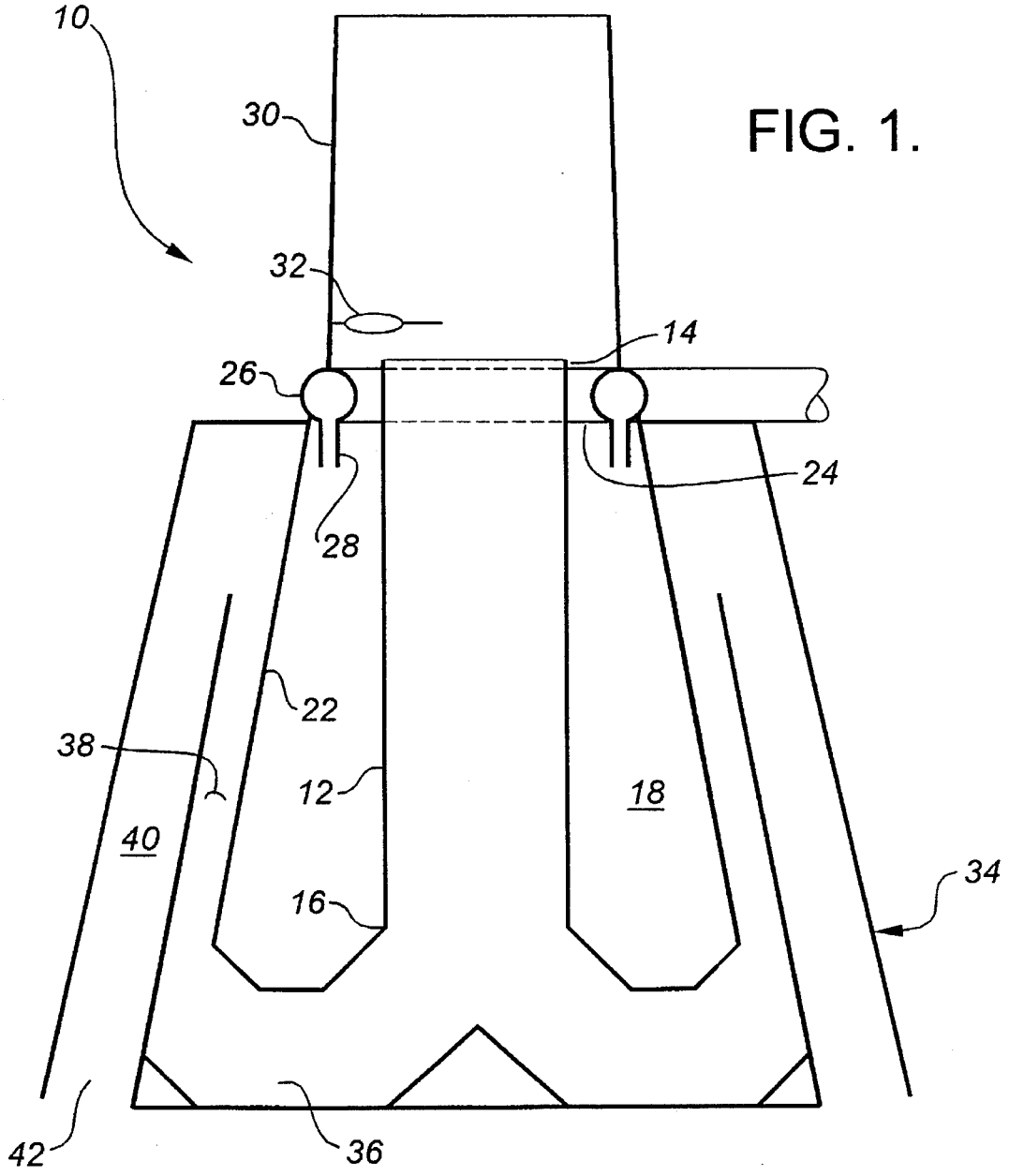
FIG. 1 is a side elevation view in section of a first embodiment of a gas flare constructed in accordance with the teachings of the present invention.

The preferred embodiment, a gas flare generally identified by reference numeral 10, will now be described with reference to FIGS. 1 and 2.

Referring to FIG. 1, there is illustrated a first embodiment of gas flare 10 which includes a vent stack 12 for combustion air having a first end 14 and a second end 16. An annular gaseous fuel cyclone cheer 18 surrounds vent stack 12. Cyclone chamber 18 has an interior wall 20 conterminous with vent stack 12 and an exterior wall 22 spaced from vent stack 12. Exterior wall 22 of cyclone chamber 18 is generally conical in shape. Cyclone chamber 18 having a narrowing defining an access opening 24 adjacent first end 14 of vent stack 12. A gaseous fuel injection ring 26 surrounds first end 14 of vent stack 12. Fuel injection ring 26 has fuel nozzles 28 extending into access opening 24 of cyclone chamber 18, such that gaseous fuel is fed into cyclone chamber 18 for thorough mixing prior to combustion. A flare stack 30 extends vertically from fuel injection ring 26. An igniter 32 is positioned in flare stack 30 above first end 14 of vent stack 12. A combustion air passage 34 communicates with second end 16 of vent stack 12. Combustion air passage 34 follows a circuitous route along exterior wall 22 of cyclone chamber 18 adjacent first end 14 of vent stack 12. Combustion air passage 34 and vent stack 12 form a generally "W" shaped configuration when viewed in section. Combustion air passage 34 has a first portion 36 extending radially outward from second end 16 of vent stack 12, a second portion 38 extending from first portion 36 along exterior wall 22 of cyclone chamber 18 toward first end 14 of vent stack 12 and a third portion 40 extending away from first end 14 of vent stack 12 parallel to second portion 38 and terminating in an inlet 42.

The use and operation of the first embodiment of gas flare 10, as illustrated in FIG. 1, will now be described. Gaseous fuel is pumped under approximately 35 pounds per square inch of pressure through fuel nozzles 28 of fuel injection ring 26 into access opening 24 of cyclone chamber 18. The gaseous fuel enters cyclone chamber 18 under pressure resulting in a turbulent flow, which leads to a thorough mixing of the gaseous fuel prior to combustion. Gaseous fuel flow under pressure from cyclone chamber 18 creates a venturi effect drawing air from vent stack 12 to form a mixture of air and gaseous fuel which is ignited by igniter 32. Cool combustion air enters inlet 42 and passes along combustion air passage 34. As the cool combustion air passes along combustion air passage 34 the cool combustion air draws heat from the metal adjacent access opening 24 of cyclone chamber 18 to reduce heat buildup in metal components adjacent first end 14 of vent stack 12.

Figure 2:
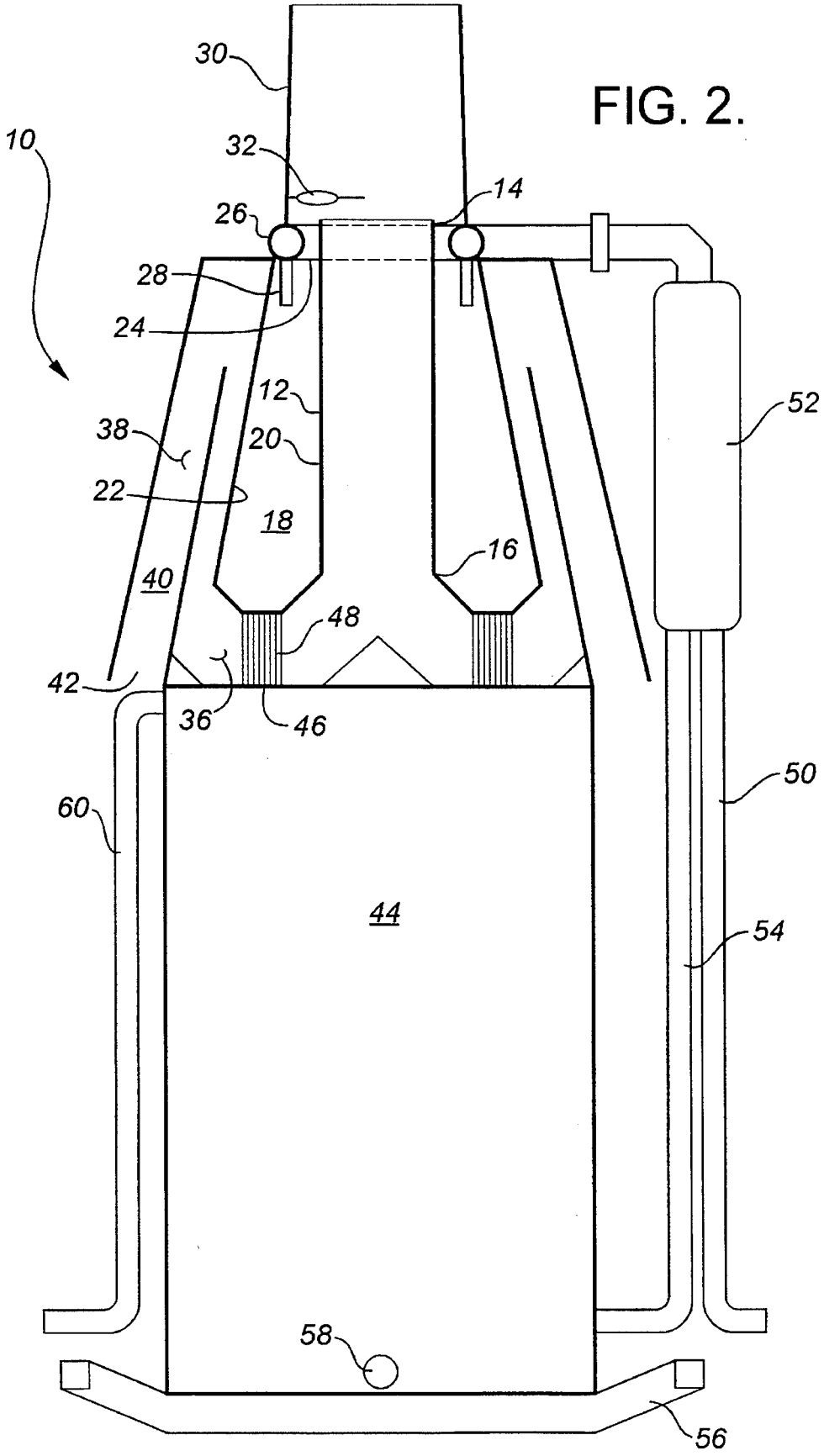
FIG. 2 is a side elevation view in section of a second embodiment of a gas flare constructed in accordance with the teachings of the present invention.

FIG. 2 illustrates a second embodiment of gas flare 10 which includes means to knock out and prevent flare up of liquid entrained in the gaseous fuel. In this embodiment a liquid containment chamber 44 is disposed beneath second end 16 of vent stack 12. First portion 36 of the combustion air passage 34 underlies cyclone chamber 18 and has drainage passages 46 communicating with underlying liquid containment chamber 44. Flame arrester cells 48 of crimped metal are positioned in drainage passages 46 thereby reducing the possibility of ignition of the liquid contents of the liquid containment chamber 44. Fuel injection ring 26 has a fuel inlet line 50 on which is positioned liquid removal means in the form of a degasser 52. A liquid drainage line 54 runs from degasser 52 to liquid containment chamber 44. Liquid containment chamber 44 has some additional features the purpose of which is obvious. Liquid containment chamber 44 is mounted on a skid 56 to facilitate movement. A drain 58 is provided through which liquid accumulations may be periodically drained. An overflow line 60 is provided to prevent liquids from entering cyclone chamber 18.

The use and operation of the liquid knockout features of the second embodiment of gas flare 10 illustrated in FIG. 2 will now be described. Gaseous fuel flowing through fuel inlet line 50 is passed through degasser 52. Degasser 52 effects a primary separation of gas and liquid. Any liquid which is removed by degasser 52 runs through liquid drainage line 54 into liquid containment chamber 44. The gaseous fuel that passes out of degasser 52 flows to fuel injection ring 26 and is injected through nozzles 28 into cyclone chamber 18. In cyclone chamber the gaseous fuel is subjected to a turbulent mixing. If further entrained liquids should be released from the gaseous fuel, such liquid falls by force of gravity to the bottom of containment chamber 18 where it is drained through drainage passages 46 into underlying liquid containment chamber 44. As flammable liquids accumulate within liquid containment chamber 44, it becomes increasingly important to take measures to prevent the ignition of the liquids. Flame arrester cells 48 positioned in drainage passages 46 serve to dissipate the heat, thereby reducing the possibility of ignition of the liquid contents of liquid containment chamber 44. In addition, any gases released from the liquids within liquid containment chamber 44 are vented through flame arrester cells 48 into cyclone chamber 18. Liquid containment chamber 44 is periodically drained by means of drain 58.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A gas flare, comprising:

a. a vent stack for combustion air having a first end and a second end;

b. a gaseous fuel cyclone chamber surrounding the vent stack and having an interior wall conterminous with the vent stack and an exterior wall spaced from the vent stack, the cyclone chamber having a narrowing defining an access opening adjacent the first end of the vent stack;

c. a gaseous fuel injection ring surrounding the first end of the vent stack with fuel nozzles extending into the access opening of the cyclone chamber, whereby gaseous fuel is fed under pressure into the cyclone chamber for thorough mixing prior to combustion;

d. an igniter positioned above the first end of the vent stack, such that gaseous fuel flowing under pressure from the cyclone chamber creates a venturi effect drawing air from the vent stack to form a mixture of air and gaseous fuel which is ignited by the igniter; and e. a combustion air passage communicating with the second end of the vent stack, the combustion air passage following a circuitous route passing along the exterior wall of the cyclone chamber adjacent the first end of the vent stack such that cool combustion air passing through the combustion air passage draws heat from cyclone chamber to reduce heat buildup adjacent the first end of the vent stack.

2. The gas flare as defined in claim 1, wherein the exterior wall of the cyclone chamber is generally conical in shape.

3. The gas flare as defined in claim 2, wherein the combustion air passage has a first portion extending radially outward from the second end of the vent stack, a second portion extending from the first portion along the exterior wall of the cyclone chamber toward the first end of the vent stack and a third portion extending away from the first end of the vent stack parallel to the second portion and terminating in an inlet.

4. The gas flare as defined in claim 1, wherein a flare stack extends vertically from the fuel injection ring.

5. The gas flare as defined in claim 1, wherein a liquid containment chamber is disposed beneath the second end of the vent stack.

6. The gas flare as defined in claim 5, wherein the first portion of the combustion air passage underlies the cyclone chamber and has drainage passages communicating with the underlying liquid containment chamber whereby liquids released from the gaseous fuel in the cyclone chamber are drained to the underlying containment chamber.

7. The gas flare as defined in claim 6, wherein flame arrester cells of crimped metal are positioned in the drainage passages thereby reducing the possibility of ignition of the liquid contents of the containment chamber.

8. The gas flare as defined in claim 5, wherein the fuel injection ring has a fuel inlet line on which is positioned liquid removal means, the liquid removal means having a drainage line communicating with the containment chamber.

9. A gas flare, comprising:

a. a vent stack for combustion air having a first end and a second end;

b. a gaseous fuel cyclone chamber surrounding the vent stack and having an interior wall conterminous with the vent stack and an exterior wall spaced from the vent stack, the exterior wall of the cyclone chamber being generally conical in shape, the cyclone chamber having a narrowing defining an access opening adjacent the first end of the vent stack;

c. a gaseous fuel injection ring surrounding the first end of the vent stack with fuel nozzles extending into the access opening of the cyclone chamber, whereby gaseous fuel is fed under pressure into the cyclone chamber for thorough mixing prior to combustion;

d. a flare stack extending vertically from the fuel injection ring;

e. an igniter positioned in the flare stack above the first end of the vent stack, such that gaseous fuel flowing under pressure from the cyclone chamber creates a venturi effect drawing air from the vent stack to form a mixture of air and gaseous fuel which is ignited by the igniter; and f. a combustion air passage communicating with the second end of the vent stack, the combustion air passage following a circuitous route passing along the exterior wall of the cyclone chamber adjacent the first end of the vent stack such that cool combustion air passing through the combustion air passage draws heat from cyclone chamber to reduce heat buildup adjacent the first end of the vent stack, the combustion air passage has a first portion extending radially outward from the second end of the vent stack, a second portion extending from the first portion along the exterior wall of the cyclone chamber toward the first end of the vent stack and a third portion extending away from the first end of the vent stack parallel to the second portion and terminating in an inlet.

10. A gas flare, comprising:

a. a vent stack for combustion air having a first end and a second end;

b. a gaseous fuel cyclone chamber surrounding the vent stack and having an interior wall conterminous with the vent stack and an exterior wall spaced from the vent stack, the exterior wall of the cyclone chamber being generally conical in shape, the cyclone chamber having a narrowing defining an access opening adjacent the first end of the vent stack;

c. a gaseous fuel injection ring surrounding the first end of the vent stack with fuel nozzles extending into the access opening of the cyclone chamber, whereby gaseous fuel is fed under pressure into the cyclone chamber for thorough mixing prior to combustion;

d. a flare stack extending vertically from the fuel injection ring;

e. an igniter positioned in the flare stack above the first end of the vent stack, such that gaseous fuel flowing under pressure from the cyclone chamber creates a venturi effect drawing air from the vent stack to form a mixture of air and gaseous fuel which is ignited by the igniter;

f. a combustion air passage communicating with the second end of the vent stack, the combustion air passage following a circuitous route passing along the exterior wall of the cyclone chamber adjacent the first end of the vent stack such that cool combustion air passing through the combustion air passage draws heat from cyclone chamber to reduce heat buildup adjacent the first end of the vent stack, the combustion air passage has a first portion extending radially outward from the second end of the vent stack, a second portion extending from the first portion along the exterior wall of the cyclone chamber toward the first end of the vent stack and a third portion extending away from the first end of the vent stack parallel to the second portion and terminating in an inlet; and g. a liquid containment chamber disposed beneath the second end of the vent stack, the first portion of the combustion air passage underlies the cyclone chamber and has drainage passages communicating with the underlying liquid containment chamber whereby liquids released from the gaseous fuel in the cyclone chamber are drained to the underlying containment chamber, flame arrester cells of crimped metal are positioned in the drainage passages thereby reducing the possibility of ignition of the liquid contents of the containment chamber, the fuel injection ring has a fuel inlet line on which is positioned liquid removal means, the liquid removal means having a drainage line communicating with the containment chamber.

* * * * *